US008136574B2

(12) United States Patent
Müller et al.

(10) Patent No.: US 8,136,574 B2
(45) Date of Patent: Mar. 20, 2012

(54) MULTI-PIECE PISTON FOR A COLD CHAMBER CASTING MACHINE

(75) Inventors: André Müller, Le Landeron (CH); Frédéric Müller, Rossens (CH)

(73) Assignee: Allper AG, Dudingen (CH)

( * ) Notice: Subject to any disclaimer, the term of this patent is extended or adjusted under 35 U.S.C. 154(b) by 649 days.

(21) Appl. No.: 11/992,716

(22) PCT Filed: Oct. 11, 2006

(86) PCT No.: PCT/EP2006/009831

§ 371 (c)(1), (2), (4) Date: Mar. 27, 2008

(87) PCT Pub. No.: WO2007/042282

PCT Pub. Date: Apr. 19, 2007

(65) Prior Publication Data

US 2009/0139683 A1 Jun. 4, 2009

(30) Foreign Application Priority Data

Oct. 12, 2005 (DE) ..... 10 2005 048 717

(51) Int. Cl.
*B22D 17/08* (2006.01)
*B22D 17/20* (2006.01)

(52) U.S. Cl. ..... 164/312

(58) Field of Classification Search ..... 164/312, 164/113; 92/255, 29
See application file for complete search history.

(56) References Cited

U.S. PATENT DOCUMENTS 4,154,288 A * 5/1979 Borgen ..... 164/314
4,598,762 A * 7/1986 Glas ..... 164/312
4,664,173 A * 5/1987 Wolniak ..... 164/312
4,899,804 A * 2/1990 Hammerer ..... 164/312
5,048,592 A 9/1991 Mueller
5,233,912 A 8/1993 Mueller

FOREIGN PATENT DOCUMENTS

| | | | |
|---|---|---|---|
| DE | 299 05 902 | U1 | 7/1999 |
| DE | 100 40 578 | C1 | 10/2001 |
| JP | H02-046961 | A | 2/1990 |
| JP | H06-017931 | A | 1/1994 |
| JP | 2004 237295 | A | 8/2004 |
| WO | WO 03/074211 | A2 | 9/2003 |
| WO | WO 2004/110679 | A | 12/2004 |

OTHER PUBLICATIONS

Machine Translation of Muller et al (WO2004/110679 A1).*
Machine Translation of Kunz (DE 10040578 C1).*
Machine Translation of Hirakawa et al (JP 2004-237295).*
International Preliminary Report on Patentability dted May 8, 2008.
Japanese Office Action issued on corresponding Japanese Patent Application No. 2008-534929.

* cited by examiner

*Primary Examiner* — Jessica L Ward
*Assistant Examiner* — Jacky Yuen
(74) *Attorney, Agent, or Firm* — Scott D. Wofsy; Edwards Wildman Palmer LLP

(57) ABSTRACT

A multi-piece piston (1) is disclosed, for fixing to the high pressure side end (3) of a piston rod (5) running axially in a casting cylinder (7) of a cold chamber casting machine. The piston comprises a piston crown (9) forming a piston front face (13) on the high pressure side and a piston body (15) in the form of a bush connected to the piston crown (9) on the low pressure side. The piston body (15) can be connected to the piston crown (9) by means of fixing screws (23) to form a module. Complementary bayonet looking means (25, 27) are provided, for axial fixing of the piston (1) to the end (3) of the piston rod (5), on the piston crown (9) and the end (3).

17 Claims, 3 Drawing Sheets

MULTI-PIECE PISTON FOR A COLD CHAMBER CASTING MACHINE

The invention relates to a multi-piece piston to be fastened to the high-pressure side end region of a piston rod displaceable axially in a casting cylinder of a cold chamber casting machine.

The conventionally cooled pistons of cold chamber casting machines are subject to relatively high wear during operation. Exchanging the piston or the wearing parts of the piston is detrimental to the productivity of the casting machine. The exchange of worn pistons takes a comparatively long time and special tools are often required, particularly since components of the piston and of the piston rod become jammed or clogged up during operation and can often only be released by force.

In order to make it easier to exchange the pistons, it is known from U.S. Pat. No. 5,233,912 A to fix the generally cap-shaped piston axially by means of a play-possessing bayonet connection to the piston carrier which also supplies the cooling fluid for piston cooling. The bayonet connection makes it easier to change the piston.

Furthermore, it is known from WO 03/074211 A and WO 2004/110679 A to construct the piston in multi-piece form. For this purpose, a piston cover forming a piston end wall on the high-pressure side is to be screw-connected to a piston body, adjoining the piston cover on the low-pressure side, in the form of a bush surrounding the piston carrier of the piston rod. The configuration makes it possible to produce the piston cover from a material other than that of the piston body, in order to implement different heat conduction conditions on the piston end wall, on the one hand, and the piston body, on the other hand. Furthermore, the divisibility of the piston makes it easier to change wearing rings of the piston, in so far as these overlap axially with the parting plane of the piston. It has been shown, however, that the screw connection between the piston cover and the piston body tends to experience wear during casting operation and that jamming and clogging cannot be ruled out.

The object of the invention is to provide a multi-piece piston for a cold chamber casting machine, which, in the event of wear, can easily be exchanged as a whole or at least in pieces.

The invention proceeds from a multi-piece piston to be fastened to the high-pressure side end region of a piston rod displaceable axially in a casting cylinder of a cold chamber casting machine and comprises:

- a piston cover forming a piston end wall on the high-pressure side,
- a piston body, adjoining the piston cover on the low-pressure side, in the form of a bush surrounding the end region of the piston rod, and
- fastening members for the releasable axial fixing of the piston cover and of the piston body in relation to the piston rod.

The object explained above is achieved, according to the invention, in that the fastening members comprise bayonet locking members axially fixing the piston cover in itself to the end region of the piston rod.

Such a bayonet connection transmits tensile forces acting on the piston cover when the piston rod is being drawn back out of the casting cylinder directly to the end region of the piston rod. This reduces the risk of problems arising during the exchange of wearing parts.

Furthermore, the design and production of the piston are simplified. In particular, the bush forming the piston body can be produced more simply than in conventional multi-piece pistons.

An essential advantage also arises for pistons with a large piston diameter. Since the end region of the piston carrier usually consists of a tough material, vibration problems may occur during the milling of the piston-rod side bayonet locking member, if these are arranged at a comparatively long distance from the end face, as is usually customary. Conventional pistons with a large diameter have therefore had to possess a comparatively short axial dimensioning in relation to the diameter, which may lead to sealing problems and cooling problems. The piston according to the invention can be produced even for relatively large piston diameters with a ratio of axial length to piston diameter of between 0.8 and 1, as has proved beneficial for pistons with a comparatively small diameter.

In a preferred refinement, there is provision for the bayonet locking members to fix the piston cover to the end region of the piston rod with axial play, in such a way that the piston end wall can be brought into axial bearing contact with the axial end face of the end region of the piston rod and can be lifted off axially from the latter. Consequently, during operation, the piston end wall can be supported over a large area on the end region of the piston rod and can discharge the pressure forces occurring during casting into the piston rod over a large area. The piston end wall can therefore have a comparatively thin dimensioning, thus making it easier to cool the piston. On account of the axial play, the piston can nevertheless be demounted without difficulty.

The bayonet locking members are expediently arranged near the axial end face of the end region of the piston rod, for example in such a way that the bayonet locking members have a plurality of pairs of mutually assigned locking projections on the piston cover and on the end region of the piston rod, at least the locking projections provided on the end region of the piston rod being arranged axially in front of the piston body toward the high-pressure side. The locking projections assigned to the piston cover may, if appropriate, overlap axially with the piston body and be utilized for the radial centering of the piston body on the piston cover.

During operation, the piston is expediently cooled by a cooling fluid which is supplied and discharged via connecting ducts of the piston rod and of its end region. In a preferred refinement, between the piston end wall of the piston cover and the end face of the end region of the piston rod and also between the inner circumferential surface of the piston body and the outer circumferential surface of the end region of the piston rod, coolant ducts are formed which are connected to one another via interspaces located in the circumferential direction between bayonet locking members. Thus, the passages or interspaces present in any case when the bayonet connection is in the locked state can be utilized for routing the coolant. The connecting ducts expediently issue in the center of the end face of the end region of the piston rod and in the region of the low-pressure side end of the piston body. It is thereby possible, contrary to conventional pistons, to bring essentially the entire piston into contact with the coolant.

A further improvement is achieved if the end region of the piston rod has, in the region of the axial overlap by the piston body, groove regions which are separated from one another by supporting webs and which form the coolant ducts. The piston body can be supported radially on the supporting webs. The groove regions expediently extend essentially in the circumferential direction of the end region of the piston rod. The groove regions may run in axially normal planes or else be designed as single-flight or multi-flight helical grooves.

The bush forming the piston body may be connected to the piston cover via fastening members to form a structural unit, but may also be fixed axially in itself solely between abutment surfaces. Regardless of whether the piston body and the piston cover form a structural unit capable of being handled independently, at least one abutment element for fixing the piston body in the axial direction and/or in the circumferential direction may be provided in the end region of the piston rod, said abutment element preferably being fastened removably to the end region of the piston rod, for example being screwed thereto by means of a screw running radially with respect to the end region. Preferably, the abutment element engages into a clearance, delimited on both sides in a circumferential direction, at the low-pressure side axial end of the piston body and thus at the same time ensures an anti-twist device for the piston body in relation to the piston rod. It will be appreciated that, for reasons of symmetry, a plurality of such abutment elements are preferably provided, distributed in the circumferential direction.

In a preferred refinement which also has independent inventive significance, that is to say may also be used in pistons other than those explained above, in particular also in one-piece pistons, there is provision for the abutment element to have an abutment surface which is obliquely inclined radially outward with respect to the piston end wall and which bears against a codirectionally inclined countersurface of the piston body. Setting the abutment surfaces obliquely reduces the risk of clogging and makes it easier to demount used pistons.

The multi-piece nature of the piston makes it possible to produce the piston cover and the piston body from different materials, so that the individual components of the piston can thereby be adapted better to their respective functional purpose. Furthermore, the multi-piece nature of the piston makes it possible to design exchangeable wearing parts which are lighter than hitherto. Thus, the piston cover may carry on its outer circumferential surface, in an annular clearance open toward the low-pressure side, a slotted radially resilient wearing ring which is fixed axially by a snap ring fixed axially on its low-pressure side to the piston cover. The snap ring may also be utilized for fixing a wearing ring or such a bush surrounding the piston body, even when both wearing rings are slotted and come radially to bear resiliently against the casting cylinder.

However, a closed wearing ring may also be shrunk with a press fit on the outer circumferential surface of the piston cover. Even such a wearing ring can be changed if it is cut open axially for this purpose. It will be appreciated that even a plurality of wearing rings may be shrunk on axially next to one another, so that even wearing rings consisting of different materials can be used closely next to one another.

It will be appreciated that the outer circumferential surface of the piston cover and/or of the piston body may be adapted as such to the inside diameter of the casting cylinder, so that the piston cover and the piston body serve themselves as wearing parts.

Alternatively, the piston cover may carry on its outer circumferential surface, in an annular clearance open toward the high-pressure side, a slotted wearing ring which, in the region of its low-pressure side axial end, has a radially inwardly projecting annular projection which engages into an annular groove on the outer circumference of the piston cover or on the outer circumference of a wearing ring surrounding the piston body. While the first-mentioned variant can also be used in conventional pistons, such as are known, for example, from WO 2004/110679 A, the second variant improves the sealing of the parting plane between the piston cover and the piston body, particularly when the wearing ring surrounding the piston body partially overlaps the piston cover axially.

In a way known per se, the piston cover may also carry a wearing ring on its outer circumferential surface in an annular clearance delimited axially toward the high-pressure side by radially projecting projections, the piston cover having passages issuing into the clearance in the circumferential direction between the projections. During the casting operation, melt can enter the annular clearance through these passages and increase the sealing action.

It will be appreciated that the end region of the piston rod may be designed in a way known per se as a piston carrier held removably on the piston rod, in order to simplify the production of the piston rod and make it possible to mount different pistons.

One-piece or even multi-piece pistons for cold chamber casting machines, such as are known, for example, from U.S. Pat. No. 5,233,912, WO 03/074211 A or WO 2004/110679 A, have, near their high-pressure side piston end wall, a wearing ring which seals off the piston with respect to the casting cylinder. The wearing ring is mostly fixed axially in an annular clearance and is mostly slotted, for example provided with a stepped slot, so that it can spread resiliently open radially in the annular clearance. Wearing rings of this type, arranged in the region of the cooled piston end wall, seal off the piston sufficiently. However, it has been shown that metal melt can penetrate into the annular clearance and may impede the radial spreadability of the wearing ring there. This leads to increased wear.

In a preferred refinement, which also has independent inventive significance, that is to say may also be used in pistons other than those explained above, particularly also in one-piece pistons, there is provision for the piston body to carry, in the region of its low-pressure side end, a slotted radially resilient wearing ring, of which the low-pressure side axial end face is exposed over the greater part of its radial thickness with respect to the piston rod. Such a wearing ring arranged on the low-pressure side cleans the casting cylinder of solidified melt residues during the reverse stroke of the piston. Since the low-pressure side axial end face of this wearing ring is exposed over the greater part to the casting cylinder surface to be cleaned, with respect to the piston rod, this prevents the surfaces provided for the axial fixing of the wearing ring from being clogged with metal residues removed from the cylinder wall and the wearing ring from becoming jammed or losing its radially resilient properties.

In conventional cold chamber casting machines, the casting cylinder has at its low-pressure side end an introduction cone which guides the piston into the casting cylinder. With each stroke, the piston is partially drawn out of the casting cylinder, but only to an extent such that its radially springing-open, high-pressure side wearing ring still remains slightly, for example two or three millimeters, in bearing contact with the circular cylindrical surface of the casting cylinder and otherwise overlaps axially with the introduction cone. Before each stroke of the piston, the high-pressure side wearing ring is supplied in the region of the introduction cone with liquid or solid lubricant which lubricates the wearing ring during the working stroke of the piston. It has been shown that, in conventional cold chamber casting machines, only part of the lubricant can be distributed to the cylinder wall and a considerable part is lost in the region of the introduction cone. During each stroke, the low-pressure side wearing ring is drawn completely out of the casting cylinder and can expand radially. During the working stroke, the low-pressure side wearing ring is compressed radially on the introduction cone. It wipes off lubricant which has remained on the introduction cone and distributes it to the casting cylinder wall during the working stroke. As a result, the lubrication of the casting cylinder is improved and the lubricant quantity required for lubrication is reduced.

The low-pressure side wearing ring explained above may be used in pistons with an additional high-pressure side wearing ring, but also in pistons without an additional high-pressure side wearing ring.

In a preferred refinement, the piston body has at its low-pressure side end, on its outer circumferential surface, an annular clearance open toward the low-pressure side. The wearing ring is arranged in its annular clearance and in the region of its high-pressure side axial end has a radially inwardly projecting annular projection which engages into an annular groove on the outer circumference of the piston body. Such a wearing ring is exposed completely on its low-pressure side end face. The annular projection provided for the axial fixing of said wearing ring is offset with respect to this end face, that is to say does not tend to become jammed. However, the annular projection may alternatively also be provided additionally on the piston body, while the annular groove assigned to it is then provided in the wearing ring.

In a preferred refinement, a further wearing ring is also provided in the region of the high-pressure side piston end wall. This wearing ring, too, is preferably slotted and is designed to be radially resilient and may be arranged in an annular clearance provided on the outer circumferential surface of the piston in the region of the piston end wall and preferably open toward the high-pressure side. Expediently, the high-pressure side and the low-pressure side wearing rings are identical, thus making stockkeeping simpler.

On the outer circumferential surface of the piston, there may be provided, axially adjacently to the low-pressure side of the high-pressure side wearing ring, an annular clearance in which solidified metal melt residues can collect, without impeding the piston movement, until they can be discharged in the rear piston position.

The low-pressure side wearing ring may likewise have, on its high-pressure side radially outer end region, an introduction cone which makes it easier to introduce the wearing ring into the casting cylinder.

Exemplary embodiments of the invention are explained in more detail below by means of a drawing in which.

Figure 1:
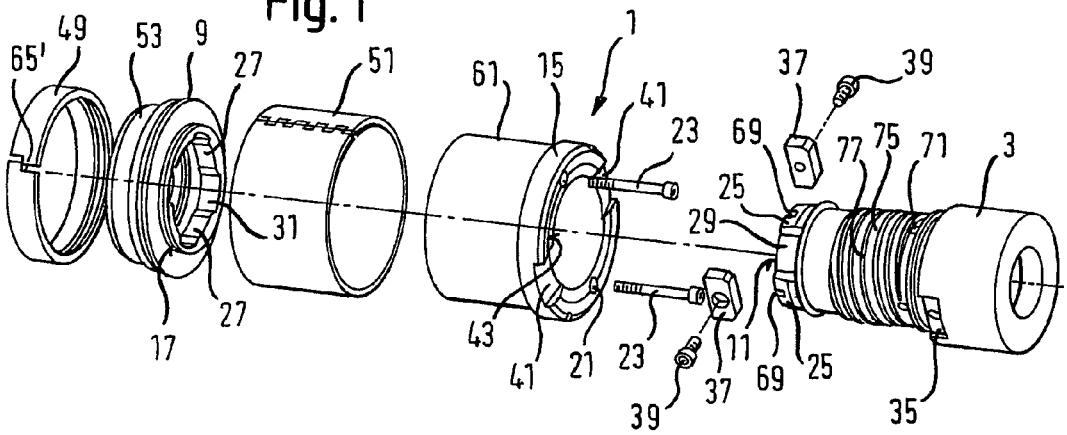
FIG. 1 shows an exploded illustration of a multi-piece piston according to the invention with an associated piston carrier forming the end region of the piston rod.
Figure 2:
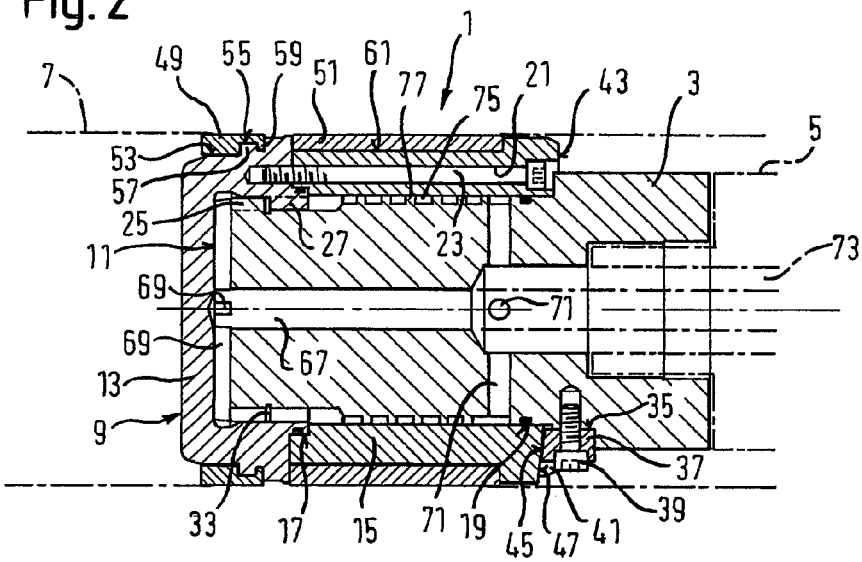
FIG. 2 shows an axial longitudinal section through the piston.

FIGS. 1 and 2 show a cap-shaped piston 1, cooled in a way explained in more detail below, of a cold chamber casting machine for metals, for example aluminum alloys. The piston 1 surrounds a piston carrier 3 which itself forms the end region of a piston rod, indicated at 5, and, for example, is screwed on to this. By means of a drive of the piston rod 5, the piston 1 is displaced in a way known per se in a casting cylinder, indicated at 7, of the cold chamber casting machine.

The piston 1 is of multi-piece design and comprises a piston cover 9 which, on the high-pressure side of the piston 1, forms a piston end wall 13 bearing over a large area against an axially normal end face 11 of the piston carrier 3. The piston cover 9 engaging over the end face 11 has adjoining it toward the low-pressure side a piston body 15 which is designed as a bush and which centers radially and is sealed off, fluid-tight, on the high-pressure side at an annular shoulder 17 of the piston cover 9 and, on the low-pressure side, at an annular shoulder 19 of the piston carrier 3. A plurality of screws 23 offset at an angle with respect to one another penetrate through the piston body 15 in axial bores 21, are screwed into the piston cover 9 from the low-pressure side and combine the piston body 15 with the piston cover 9 to form a structural unit.

The structural unit of the piston 1, said structural unit consisting of the piston cover 9 and of the piston body 15, is fastened together axially by means of mutually assigned pairs of bayonet locking members 25, 27 which are integrally formed, in each case offset in the circumferential direction, on the piston carrier 3 and on the piston cover 9. The bayonet locking members 25, 27 leave free between them passages 29 and 31, through which the bayonet locking members 25, 27 can be inserted axially past one another, before they are locked axially with one another by the piston cover 9 being rotated in relation to the piston carrier 3. As FIG. 2 shows best, in the locked state, there remains between the bayonet locking members 25, 27 an axial play 33 which, on the one hand, makes it possible for the piston end wall 13 to be supported against the end face 11 and, on the other hand, prevents clogging. Since the piston cover 9 is supported directly on the piston carrier 3, the forces acting on the piston cover 9 when the piston rod 5 is being drawn back in the direction of the low-pressure side are introduced directly into the piston carrier 3. Likewise, during the drawback movement, the piston body 15 is also supported directly on the piston cover 9, without forces having to be conducted via the fastening screws 23. During the movement of the piston rod 5 toward the high-pressure side, the forces acting on the piston end wall 13 are absorbed, in turn, directly by the end face 11 of the piston carrier 3.

On the low-pressure side of the piston body 15, a plurality of abutment elements 37 are seated, distributed in the circumferential direction, in respectively assigned countersinks 35 of the piston carrier 3 and are held on the piston carrier 3 by means of radially releasable screws 39. Each of the abutment elements 37 in this case engages into a clearance 41 on the low-pressure side end face 43 of the piston body 15 and positively fixes the piston body 15 and consequently also the piston cover 9 fixedly in terms of rotation on the piston carrier 3.

In order to prevent the situation where, during casting operation, the abutments elements 37 may stick by clogging to the piston body 15 and be released only with difficulty, the abutment surface 45 of each abutment element, said abutment surface facing the piston body 15 axially, runs so as to be obliquely inclined radially outward with respect to the high-pressure side. The oblique abutment surface 45 bears against a codirectionally running abutment countersurface 47 formed by the bottom of the clearance 41. The abutment element 37 is consequently in the form of a wedge which tapers radially inward and which can be drawn out of the clearances 35, 41 without difficulty in order to release the piston 1 from the piston carrier 3.

The piston 1 carries on its outer circumference slotted wearing rings 49, 51 spreading open radially resiliently. The high-pressure side wearing ring 49 is seated in an annular clearance 53, open toward the high-pressure side, on the outer circumference of the piston cover 9 and has an inner circumferential groove 55 into which a radially outwardly projecting annular collar 57 of the piston cover 9 engages. The circumferential groove 55 engages with a radially inwardly projecting annular projection 59 behind the annular collar 57. The low-pressure side wearing ring 51 is in the form of a bush and is received by a clearance 61, open toward the high-pressure side, of the piston body 15. For axial fixing, the wearing ring 51 is supported toward the high-pressure side on the piston cover 9.

Figure 3:
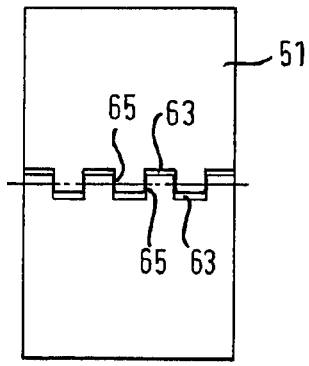
FIG. 3 shows a radial view of a wearing bush of the piston.
Figure 4:
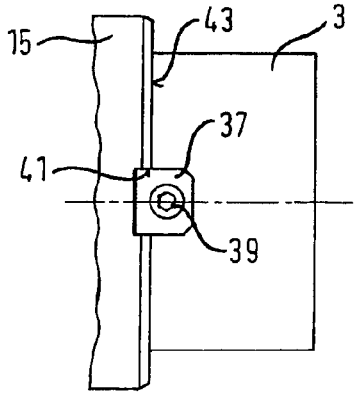
FIG. 4 shows a radial view of an abutment element of the piston carrier.

The wearing means 49, 51 are slotted, their slot edges 63 forming a plurality of steps with circumferentially running step surfaces 65 bearing against one another, as shown in FIG. 3. The high-pressure side wearing ring 49 likewise has a step 65' of the type explained which can be seen in FIG. 1.

The cooling fluid for cooling the piston 1 is delivered to the end face 11 via the piston rod 5 and a central duct 67 of the piston carrier 3. Incorporated in the end face 11 are radial ducts 69 in which the cooling fluid is in contact with the piston end wall 13. Via the passages 29, 31 of the bayonet connection which are in alignment with one another during operation, the cooling fluid flows on the outer circumference of the piston carrier 3 into the region of the low-pressure side end of the piston body 15, where radial ducts 71 of the piston carrier 3 supply the cooling fluid to a central annular duct 73 of the piston carrier 3 or of the piston rod 5. Between the passages 29, 31 and the ducts 71, the piston carrier 3 is provided on its outer circumference with a single-flight or multi-flight helical groove 75, the turns of which are separated from one another by supporting webs 77. The piston body 15 is supported radially on the supporting webs 77. The grooves 75 form coolant ducts, by which the cooling fluid can come into heat exchange contact with the piston body 15. Instead of the helical groove 75, a multiplicity of mutually parallel circumferential grooves may also be provided, in so far as these are connected to one another by means of axial ducts. It will be appreciated that only axially running grooves may also be provided instead of the grooves 75 running essentially in the circumferential direction.

Variants of the piston design explained by means of FIGS. 1 to 4 are described below. Identically acting components are designated by the reference numerals of FIGS. 1 to 4 and, to distinguish them, are given a letter. To explain the set-up and type of operation and also to explain possible variants, reference is made in each case to the overall description given above.

Figure 5:
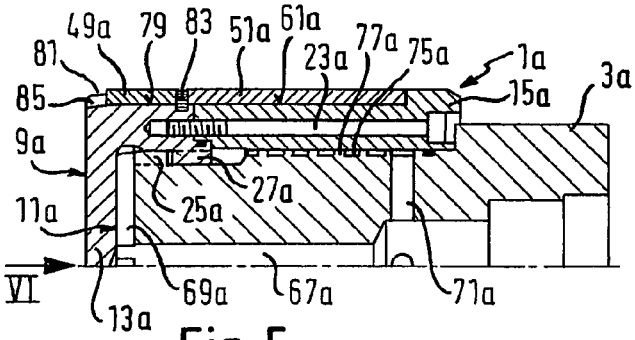
FIG. 5 shows an axial longitudinal half section through a first variant of the piston.
Figure 6:
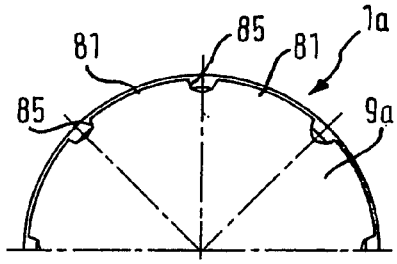
FIG. 6 shows an end view of the piston, as seen in the direction of an arrow VI in FIG. 5.

FIGS. 5 and 6 show a first variant of a piston 1*a*, on which the components and features 3 to 51 and 61 to 77 of the piston 1 of FIGS. 1 to 4 are likewise implemented. In contrast to the piston 1, the high-pressure side, again slotted wearing ring 49*a* is seated in a clearance 79, open toward the low-pressure side, on the circumference of the piston cover 9*a* and is fixed axially toward the high-pressure side by means of radial projections 81. A spring ring 83 snapped into an annular clearance of the piston cover 9*a* ensures axial fixing toward the low-pressure side. The spring ring 83 also assumes the axial fixing of the wearing ring 51*a* seated in the clearance 61*a* on the outer circumference of the piston body 15*a* and designed as a slotted bush.

Provided in the circumferential direction between the radial projections 81 are passages 85, through which melt can enter the clearance 79 during operation, where it assists the resilient spreading open of the wearing ring 49*a*. Reference is also made in this respect to WO 2004/110679 A1.

The piston 1*a* of FIGS. 5 and 6 comprises, even though this may not be explained in detail, the components 3 to 51 and 61 to 77 of the piston 1 of FIGS. 1 to 4.

Figure 7:
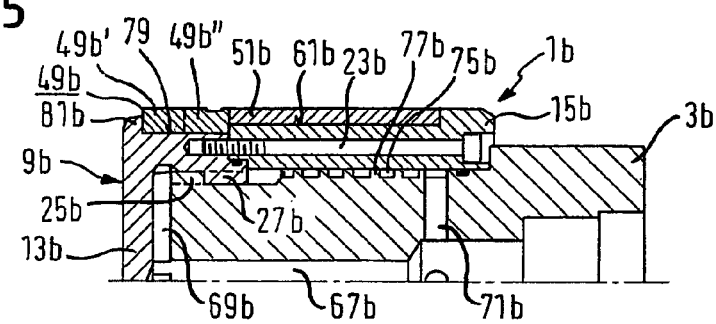
FIGS. 7 to 10 show axial longitudinal half sections through second to fifth variants of the piston.

FIG. 7 shows a piston 1*b* which differs from the piston 1*a* of FIGS. 5 and 6 in that the high-pressure side wearing ring 49*b* is designed as a closed ring and is shrunk with a press fit on to the clearance, open toward the low-pressure side, on the outer circumference of the piston cover 9*b*. The low-pressure side wearing ring 51*b* is fixed axially between the high-pressure side wearing ring 49*b* and a low-pressure side shoulder of the clearance 61*b* of the piston body 15*b*. The wearing ring 51*b* is designed as a slotted bush in a similar way to the wearing ring of FIG. 3. Contrary to the piston 1*a* of FIGS. 5 and 6, the radial projection 81*b* provided on the piston end face is closed in a circumferential direction. However, its outside diameter is smaller than the outside diameter of the wearing ring 49*b*. In addition to the components explained, the piston lb comprises the components 3 to 51 and 61 to 77 of the piston 1 of FIGS. 1 to 4.

As indicated at 49*b*' and 49*b*", the wearing ring 49*b* may also be composed of a plurality of wearing ring elements arranged directly next to one another axially and shrunk on to the piston cover 9*b* in the clearance 79*b*. The multi-piece nature of the wearing ring makes attachment and removal easier. Furthermore, the ring elements 49*b*' and 49*b*" may consist of different materials. For example, the high-pressure side ring element 49*b*' may be produced from a more wear-resistant material than the ring element 49*b*" and/or the ring element 49*b*" may have better sliding properties than the ring element 49*b*".

Figure 8:
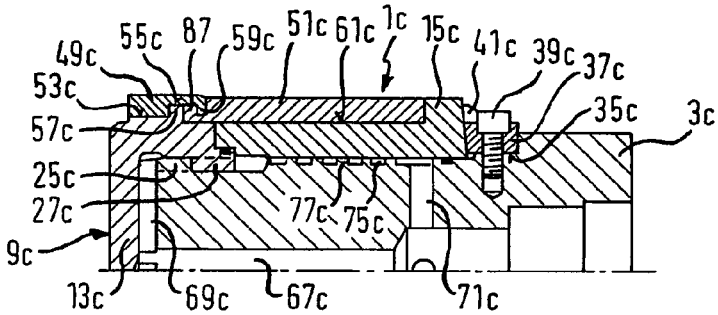

The piston 1*c* illustrated in FIG. 8 is a variant of the piston 1 of FIGS. 1 to 4 and differs from this piston essentially only in that the high-pressure side wearing ring 49*c* overlaps the low-pressure side wearing ring 51*c* axially, the inner annular groove 55*c* of the wearing ring 49*c* having engaging into it not only the annular projection 57*c* of the piston cover 9*c*, but also an annular projection 87 provided at the high-pressure side end of the wearing ring 51*c*. Both wearing rings 49*c* and 51*c* are again designed as slotted rings, the bush-shaped wearing ring 51*c* overlapping axially with the piston cover 9*c* and being fixed axially by the projection 57*c*. The overlapping of the wearing rings 49*c*, 51*c* increases the sealing action of the piston 1*c*. In addition to the above-explained components of the piston 1*c*, the components 3 to 77 of the piston 1 of FIGS. 1 to 4 are also present.

Figure 9:
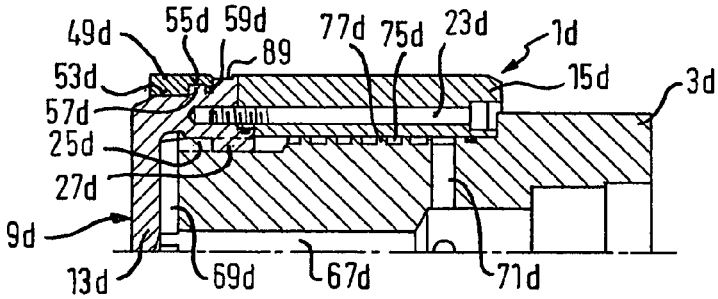

The piston 1*d* illustrated in FIG. 9 is a further variant of the piston 1 of FIGS. 1 to 4 and differs from this piston essentially only in that the piston body 15*d* carries no additional wearing ring, but is itself designed as a wearing part. The outside diameter of the piston body 15*d* is closely adapted to the inside diameter of the casting cylinder. In so far as there is no further explanation, the components 3 to 49 and 76 to 77 of the piston 1 of FIGS. 1 to 4 are present. The piston cover 9*d* extends axially beyond the wearing ring 49*d* toward the low-pressure side and on the low-pressure side of the wearing ring 49*d* is provided with an annular clearance 89 which directly adjoins the latter and in which metal melt which has gone past the wearing ring 49*d* toward the low-pressure side can collect and solidify. The metal residues can thereby be removed from the casting cylinder when the piston 1*d* is in its rear end position and consequently essentially outside the casting cylinder.

Figure 10:
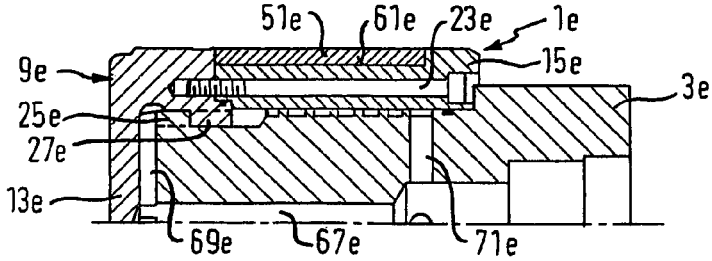

FIG. 10 shows a further variant of the piston 1 of FIGS. 1 to 4. The piston le shown in FIG. 10 differs from the piston 1 essentially only in that the piston cover 9*e* is itself designed as a wearing part, a high-pressure side wearing ring held on its circumference being dispensed with. The outside diameter of the piston cover 9*e* is closely adapted to the inside diameter of the casting cylinder. The components 3 to 47, 51 and 61 to 77 of the piston 1 are also implemented on the piston 1*e*. It will be appreciated that the piston cover designed as a wearing part may also be used in the piston 1*d* of FIG. 9. Furthermore, the piston body 15*d*, designed as a wearing part, of the piston 1*d* from FIG. 9 may also be provided in the variants of FIGS. 5 to 8, in this case the high-pressure side wearing ring 49*c* overlapping axially with the piston body in the piston 1*c* of FIG. 8.

Figure 11:
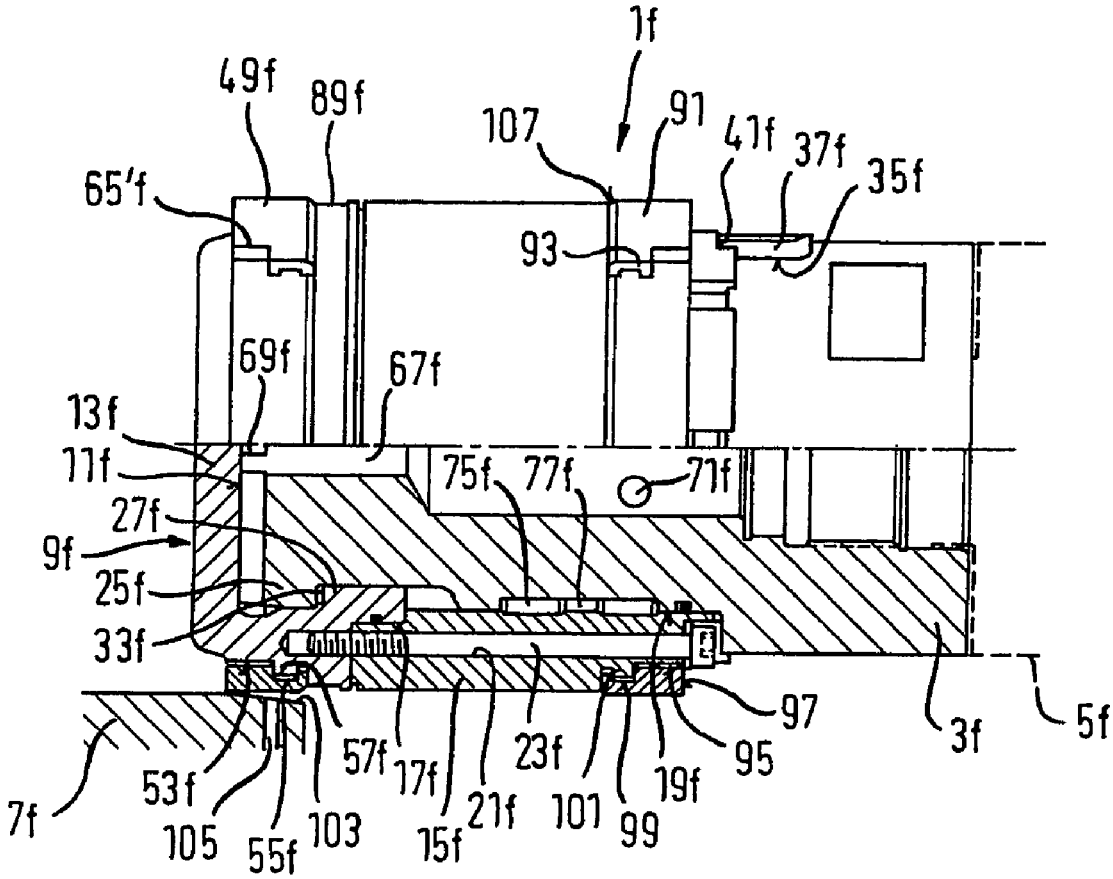
FIG. 11 shows a sixth variant of the piston partially in axial longitudinal section.

FIG. 11 shows a further variant of a piston 1*f* which differs from the piston 1*d* of FIG. 9 essentially only in that a slotted wearing ring 91 is also arranged at the low-pressure side end of the piston body 15*f*. In the exemplary embodiment illustrated, the wearing ring 91 is identical to the high-pressure side wearing ring 49*f*, but is installed in the opposite direction axially. Its stepped slot can be seen at 93. The low-pressure side wearing ring 91 is arranged radially resiliently and consequently expandably in a clearance 95 open toward the low-pressure side of the piston and consequently toward the piston rod 5*f* and, at a distance from its axial end face 97, consequently exposed essentially over the entire height, has an annular groove 99 into which an annular projection 101 projecting radially from the piston body 15*f* engages. The annular projection 101 fixes the wearing ring 91 radially movably on the piston body 15*f*.

FIG. 11 shows the piston 1*f* in its rear end position, drawn out essentially from the casting cylinder 7*f*, in which, however, the high-pressure side wearing ring 49*f* is still held, compressed, in the circular-cylindrical wall region of the casting cylinder 7*f*. The wearing ring 49*f* in this case otherwise overlaps with an introduction cone 103 at the end of the casting cylinder 7*f*, said introduction cone making it easier to introduce the wearing ring 49*f* which spreads open outside the casting cylinder 7*f*.

One or more supply ducts 105, via which the wearing ring 49*f* can be wetted with a small quantity of lubricant, terminate in the region of the introduction cone 103. The lubricant reduces the friction of the piston against the cylinder wall during the working stroke. It will be appreciated that the lubricant may also be supplied in another way to the wearing ring 49*f* overlapping with the introduction cone 103. The lubricant may be a dry, but also a liquid lubricant.

When the piston 1*f* is pushed into the casting cylinder 7*f* during the working stroke, part of the lubricant is caught on the introduction cone 103 and is subsequently taken up into the casting cylinder 7*f* by the low-pressure side wearing ring 91, after the wearing ring 91, during its entry into the casting cylinder 7*f*, has been compressed by means of the introduction cone 103. In order to make this easier, the wearing ring 91 has a conical chamfer 107 at its radially outer high-pressure side annular edge.

During the reverse stroke back into the end position illustrated in FIG. 11, the wearing ring 91 wipes off melt residues which have possibly remained on the inner wall of the casting cylinder 7*f* and thus cleans the casting cylinder 7*f* with each stroke. Since the end wall 97 of the wearing ring 91 is exposed and is not overlapped by surfaces for the axial fixing of the wearing ring 91, the tendency of the wearing ring 91 to become jammed is low.

It would be appreciated that the wearing ring 91 may also be provided in the above-explained variants of the multi-piece piston, specifically even when the piston cover is connected in one piece with the piston body and/or the piston has no high-pressure side wearing ring.

It would be appreciated, furthermore, that the wearing bushes 51, 51*a*-51*c* and 51*e* explained with reference to FIGS. 1 to 8 and 10 may, if appropriate, also be formed by two or more wearing rings arranged axially next to one another, but separated from one another. These wearing rings may themselves be slotted, in particular slotted in a stepped manner, or else be closed annularly. Insofar as the wearing rings are slotted, their radial pressure force can be increased by means of radial springs, such as, for example, helical compression springs, which are seated in blind holes of the piston body.

The invention claimed is:

1. A multi-piece piston to be fastened to a high-pressure side end region of a piston rod displaceable axially in a casting cylinder of a cold chamber casting machine, comprising a piston cover forming a piston end wall on the high-pressure side wherein the piston cover is adapted to bring the piston end wall thereof in direct axial bearing contact with an axial end face of the end region of the piston rod, a piston body, axially adjoining the piston cover on its low-pressure side, in the form of a bush adapted to surround the end region of the piston rod, fastening members for releasable axial fixing of the piston cover and of the piston body in relation to the piston rod, wherein the fastening members comprise a plurality of bayonet locking members provided on the piston cover and adapted to axially fix the piston cover directly to the end region of the piston rod through a plurality of bayonet locking members provided on the end region of the piston rod and being mutually assigned in pairs to the bayonet locking members of the piston cover, wherein the pairs of mutually assigned locking members are offset in the circumferential direction and leave free passages between them, and wherein the piston cover and the piston body are adapted to form a first coolant duct between the piston end wall of the piston cover and the axial end face of the end region of the piston rod and a second coolant duct between an inner circumferential surface of the piston body and an outer circumferential surface of the end region of the piston rod, and wherein the first and second coolant ducts are connected to one another through the passages between the pairs of locking members and are adapted to bring substantially the entire length of the piston body into contact with coolant.

2. The piston as claimed in claim 1, wherein the bayonet locking members fix the piston cover to the end region of the piston rod with axial play, in such a way that the piston end wall can be brought into axial bearing contact with the axial end face of the end region of the piston rod and can be lifted off axially from the latter, and wherein the bayonet locking members have a plurality of pairs of mutually assigned locking projections on the piston cover and on the end region of the piston rod, at least the locking projections provided on the end region of the piston rod being arranged axially in front of the piston body toward the high-pressure side.

3. The piston as claimed in claim 1, wherein the coolant ducts are connected to connecting ducts in the region of a center of the end face of the end region and in the region of a low-pressure side end of the piston body.

4. The piston as claimed in claim 3, wherein the end region of the piston rod has, in a region of axial overlap by the piston body, groove regions running essentially in the circumferential direction which form the second coolant ducts, wherein the groove regions are separated from one another by supporting webs.

5. The piston as claimed in claim 4, wherein the end region of the piston rod has at least one helical groove surrounding the end region.

6. The piston as claimed in claim 1, wherein the piston body is centered radially on the piston cover by means of an annular shoulder.

7. The piston as claimed in claim 1, wherein the piston body is fastened fixedly in teens of rotation, by means of fastening members to the piston cover and with the latter forms a structural unit, wherein at least one abutment element for fixing the piston body in the axial direction and/or in the circumferential direction is provided on the end region of the piston rod, wherein the abutment element is fastened removably to the end region of the piston rod, and wherein the abutment element has an abutment surface which is obliquely inclined radially outward with respect to the piston end wall and which bears against a codirectionally inclined countersurface of the piston body.

8. The piston as claimed in claim 7, wherein the abutment element engages into a clearance, delimited on both sides in the circumferential direction, at the low-pressure side axial end of the piston body.

9. The piston as claimed in claim 7, wherein a plurality of abutment elements distributed in the circumferential direction are in each case screwed in themselves to the end region by means of screws running radially with respect to the end region of the piston rod.

10. The piston as claimed in claim 1, wherein the piston cover carries on its outer circumferential surface, in an annular clearance open toward the low-pressure side, a slotted radially resilient wearing ring which is fixed axially by a snap ring fixed axially on its low-pressure side to the piston cover.

11. The piston as claimed in claim 1, wherein at least one closed wearing ring is shrunk with a press fit on the outer circumferential surface of the piston cover, in particular a plurality of closed wearing rings are shrunk on with a press fit closely next to one another axially.

12. The piston as claimed in claim 1, wherein the outer circumferential surface of the piston cover and/or of the piston body is adapted as such to the inside diameter of the casting cylinder.

13. The piston as claimed in claim 1, wherein the piston cover carries on its outer circumferential surface, in an annular clearance open toward the high-pressure side, a slotted wearing ring which, in the region of its low-pressure side axial end, has a radially inwardly projecting annular projection which engages into an annular groove on the outer circumference of the piston cover or on the outer circumference of a wearing ring surrounding the piston body.

14. The piston as claimed in claim 13, wherein the wearing ring surrounding the piston body partially overlaps the piston cover axially.

15. The piston as claimed in claim 1, wherein the piston cover and/or the piston body carries on the outer circumference a slotted wearing ring, the slot edges of which form at least one step with step surfaces running in the circumferential direction and bearing one against the other.

16. The piston as claimed in claim 1, wherein the piston cover carries a wearing ring on its outer circumferential surface in an annular clearance delimited axially toward the high-pressure side by radially projecting projections, the piston cover having passages issuing into the clearance in the circumferential direction between the projections.

17. The piston as claimed in claim 1, wherein the end region of the piston rod is designed as a piston carrier held removably on the piston rod.

* * * * *